US007530187B1

(12) United States Patent
Dreka

(10) Patent No.: US 7,530,187 B1
(45) Date of Patent: May 12, 2009

(54) SELF-CONTAINED WARNING SIGN CARRIER FOR VEHICLES

(76) Inventor: Todd Dreka, 3224 Old Squaw Loop, Wasilla, AK (US) 99654

( * ) Notice: Subject to any disclaimer, the term of this patent is extended or adjusted under 35 U.S.C. 154(b) by 0 days.

(21) Appl. No.: 11/818,708

(22) Filed: Jun. 15, 2007

(51) Int. Cl.
*G09F 21/04* (2006.01)

(52) U.S. Cl. ..... 40/591; 40/590; 40/604; 40/514; 160/242

(58) Field of Classification Search ..... 40/591, 40/588, 590, 603, 604, 514; 297/97.8; 160/242
See application file for complete search history.

(56) References Cited

U.S. PATENT DOCUMENTS

| | | | | | |
|---|---|---|---|---|---|
| 1,437,479 | A * | 12/1922 | Stromberg et al. | ..... | 160/128 |
| 3,430,374 | A * | 3/1969 | Woodard | ..... | 40/591 |
| 3,629,910 | A * | 12/1971 | Kirberg et al. | ..... | 24/613 |
| 3,949,503 | A * | 4/1976 | Waress | ..... | 40/591 |
| 4,292,751 | A * | 10/1981 | Snyder, Jr. | ..... | 40/517 |
| 5,097,611 | A * | 3/1992 | Smollar et al. | ..... | 40/514 |
| 5,398,437 | A * | 3/1995 | Bump et al. | ..... | 40/582 |
| 5,893,226 | A * | 4/1999 | Sophocleous et al. | ..... | 40/591 |
| 6,195,925 | B1 * | 3/2001 | Werner | ..... | 40/591 |
| 6,715,526 | B1 * | 4/2004 | Brownfield et al. | ..... | 160/24 |
| 7,395,776 | B2 * | 7/2008 | Harruna | ..... | 116/28 R |
| 2004/0025391 | A1 * | 2/2004 | Storm | ..... | 40/591 |
| 2005/0081413 | A1 * | 4/2005 | Ko | ..... | 40/514 |
| 2007/0044359 | A1 * | 3/2007 | Worley | ..... | 40/590 |

* cited by examiner

*Primary Examiner*—Gary C Hoge
(74) *Attorney, Agent, or Firm*—Michael J. Tavella

(57) ABSTRACT

A warning sign that is attached to a spring-loaded roller contained in a housing, which is then secured to the truck or trailer. When the sign must be displayed, the driver simply pulls the sign from the housing and extends it across the vehicle's bumper. When it is fully extended, the free end is secured to mounting fasteners located on the vehicle. In this way, the sign is ready for use, clean and in good condition. After the load has been hauled and the sign is no longer needed, it can be released and rolled back inside the housing, ready for the next use. The housing can be installed on trucks, pilot vehicles, heavy equipment, and trailers and can be deployed whenever needed simply be pulling the sign out and securing it to the vehicle.

17 Claims, 8 Drawing Sheets

SELF-CONTAINED WARNING SIGN CARRIER FOR VEHICLES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to warning signs for vehicles and particularly to self-contained warning sign carrier for vehicles, including trailers.

2. Description of the Prior Art

Today, freight hauling involves many consolidated loads that travel as piggyback trailers, where two semi-trailers are attached to one tractor. These oversized vehicles frequently take to the road and present a hazard to other motorists who are unaware of the total vehicle length that may be in front or behind them. To alert motorists to this danger, the government requires such vehicles to be marked with large signs indicating that the vehicle (including trailers) is "oversize" or has a "long load", "wide load", or "oversize load".

In addition to the piggyback trailers, many other vehicles, such as large pieces of construction equipment and even houses are being transported on the roads. All of these vehicles must have these warning signs. In cases of unusual loads, pilot vehicles may be required to be position before and after the actual load. These vehicles too, must have the appropriate warning signs attached. Typically, these signs are about 5 feet long and one foot wide. Although Regulations vary from state to state, the signs can be up to 18 inches high and up to 84 inches long. They are fitted with grommets that allow cords to attached so that the sign can be tied to the vehicle.

Often, a truck driver may not be aware that he or she will be pulling an oversized load until the driver arrives at the pick-up point. Then, they often have to dig through equipment; tools and other things stored in the truck t locate the signs. Typically, these signs have been folded and may be torn or dirty. They have to be tied onto the truck and the load, typically using bungee cords or other thin ropes. All this takes time and produces a less than optimum result.

BRIEF DESCRIPTION OF THE INVENTION

The instant invention over comes all of these problems. It is a warning sign that is attached to a spring-loaded roller. The roller and sign are contained in a housing, which is then secured to the truck or trailer bumper. The sign is thus carried at al times. When the sign must be displayed, the driver simply pulls the sign from the housing and extends it across the vehicle's bumper. When it is fully extended, the free end is secured to mounting fasteners located on the bumper. In this way, the sign is ready for use, clean and in good condition. After the load has been hauled and the sign is no longer needed, it can be loosened from the bumper and rolled back inside the housing, ready for the next use.

The housing can be installed on trucks, pilot vehicles, heavy equipment, and trailers and can be deployed whenever needed simply be pulling the sign out and securing it to the bumper.

DETAILED DESCRIPTION OF THE INVENTION

Figure 1:
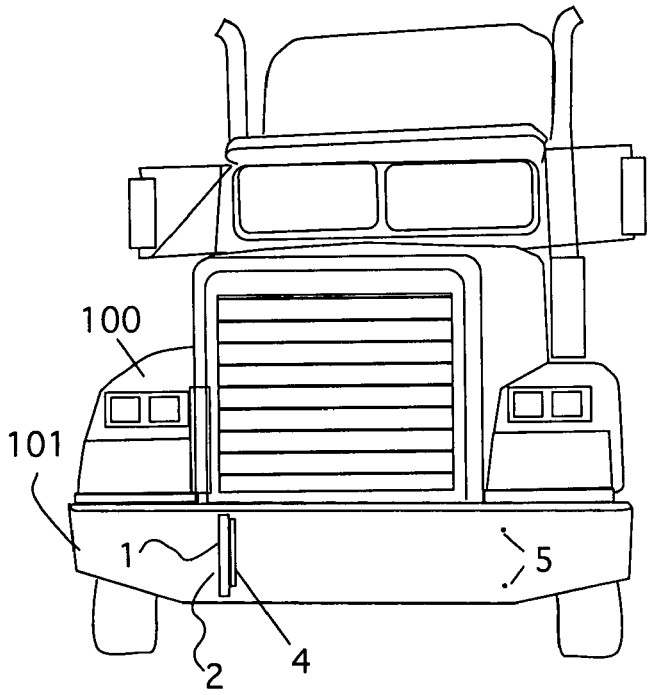
FIG. 1 is a front view of a tractor-trailer showing the invention stored and not in use.

Referring now to FIG. 1, a front view of a tractor-trailer showing the invention stored. In this view, the truck 100 has a bumper 101. The invention 1 is shown attached to the bumper as shown. The invention is a cylinder 2 that has a sign 3 secured to a spring winding mechanism similar to that of a window shade or self-winding movie screen. The distal end 4 of the sign 3 is shown protruding from the cylinder 2. This allows the operator to pull the sign from the cylinder when needed. Fasteners 5 (discussed below) are secured to the opposite side of the bumper 101 as shown, at a suitable location to hold the distal end of the sign when it is extended.

Note that this device is intended for use on any vehicle, including pick-up trucks, trucks and trailers that have frames with an external covering (such as doors, side panels, grills, bumpers etc.) as well as trailers such as lowboy designs, cars and heavy construction equipment. It is not intended to be limited to one type of vehicle or to one position on a vehicle.

Figure 1A:
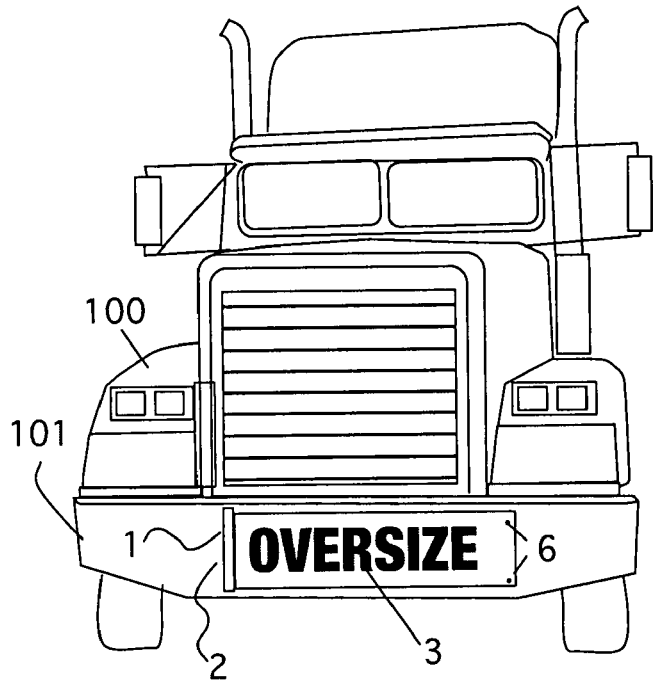
FIG. 1*a* is a front view of a tractor-trailer showing the invention deployed for use.

FIG. 1*a* is, a front view of a tractor-trailer showing the sign extended for use. The sign 3 has grommeted slots or holes 6 formed in the distal end to secure the sign to the bumper on the fasteners 5 (as discussed below) when it is extended. As shown in this figure, the sign has the message "OVERSIZE". However, any other message that is acceptable for use on highways, such as "LONG LOAD", "OVERSIZE LOAD" or "WIDE LOAD" may be used as well.

Figure 2:
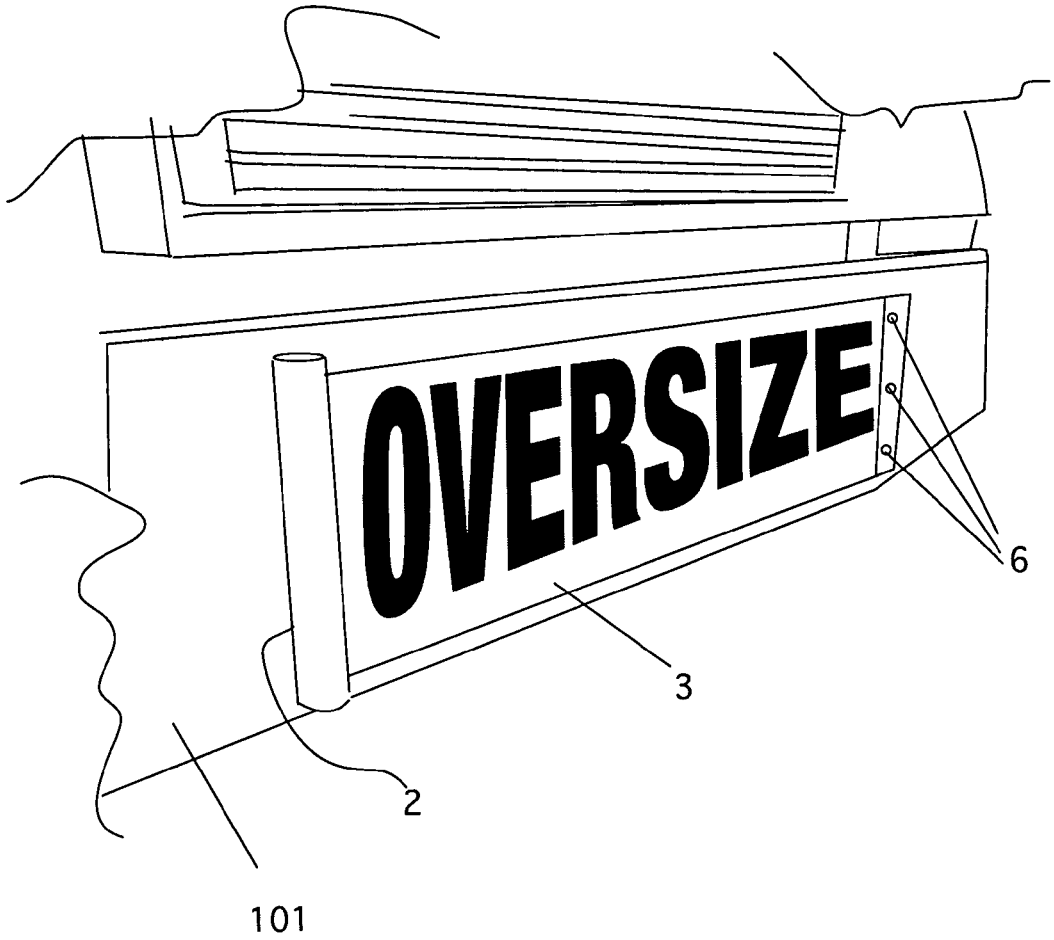
FIG. 2 is a detail view of the truck bumper with the invention deployed for use.

FIG. 2 is a detail view of the truck bumper with the invention deployed for use. Here, the cylinder 2, sign 3 and grommets 6 are shown on a bumper 101. Here, three grommets are shown, although, the number can vary from one to more, as needed.

Figure 3:
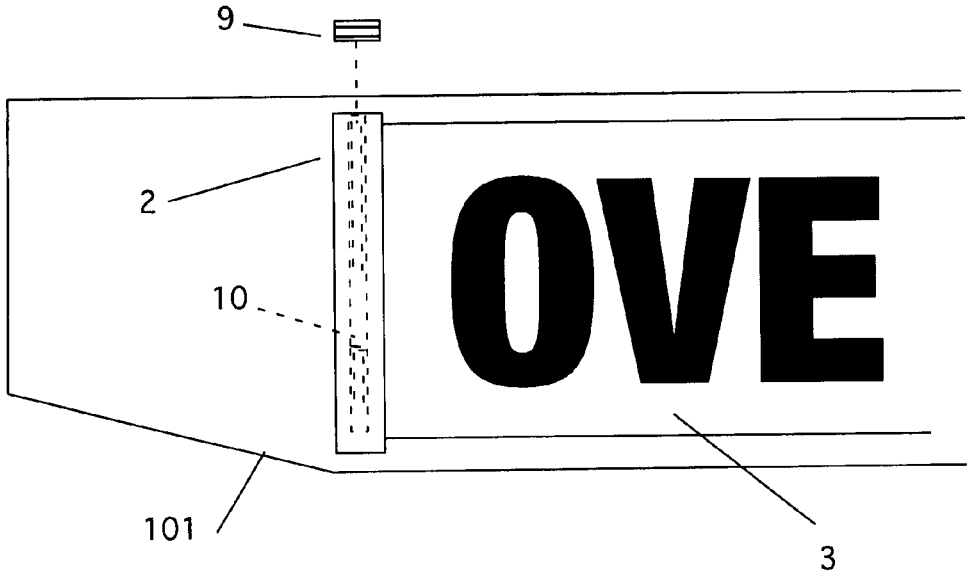
FIG. 3 is a front view of the device showing portions of the winding mechanism.

FIG. 3 is a front view of the device showing portions of the winding mechanism. In this figure, the cylinder 2 is shown.

Inside the cylinder is the winding mechanism 10, which, as noted above, is a common spring-type winding mechanism used, for example, in window shades. Note that this view also shows the cap 9 of the cylinder 2.

Figure 4:
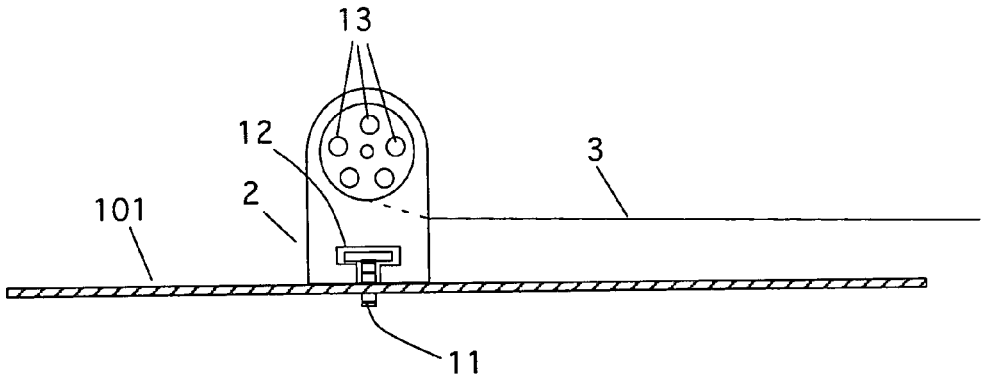
FIG. 4 is a detail of the bottom of the device showing one system for mounting the cylinder.

FIG. 4 is a detail of the bottom of the device showing one system for mounting the cylinder. Here, the bumper 101 is shown. The cylinder 2 is shown attached to the bumper. There are many ways to attach the device to the bumper, including directly bolting the cylinder to the bumper, or by attaching it to the bumper with powerful magnets, for example. The preferred method is one that enables the cylinder to be removed, if needed. This method uses 2 bolts or screws 11 that are mounted in a vertical line in the bumper using nuts or other fastening means. The bolts are spaced apart at the proper interval. They protrude from the bumper face as shown. Two slots 12 are formed in the back of the cylinder 2 in a spaced apart configuration that matches the interval of the bolts. The cylinder is mounted by aligning the slots with the bolts and sliding the cylinder down over the bolts until the bolts reach the tops of the slots. At this point, the cylinder is securely attached to the bumper, but can easily be removed by pulling upward on the cylinder until it clears the bolt heads. Note that this figure also shows a number of holes 13 to allow water to drain from the cylinder.

Figure 5:
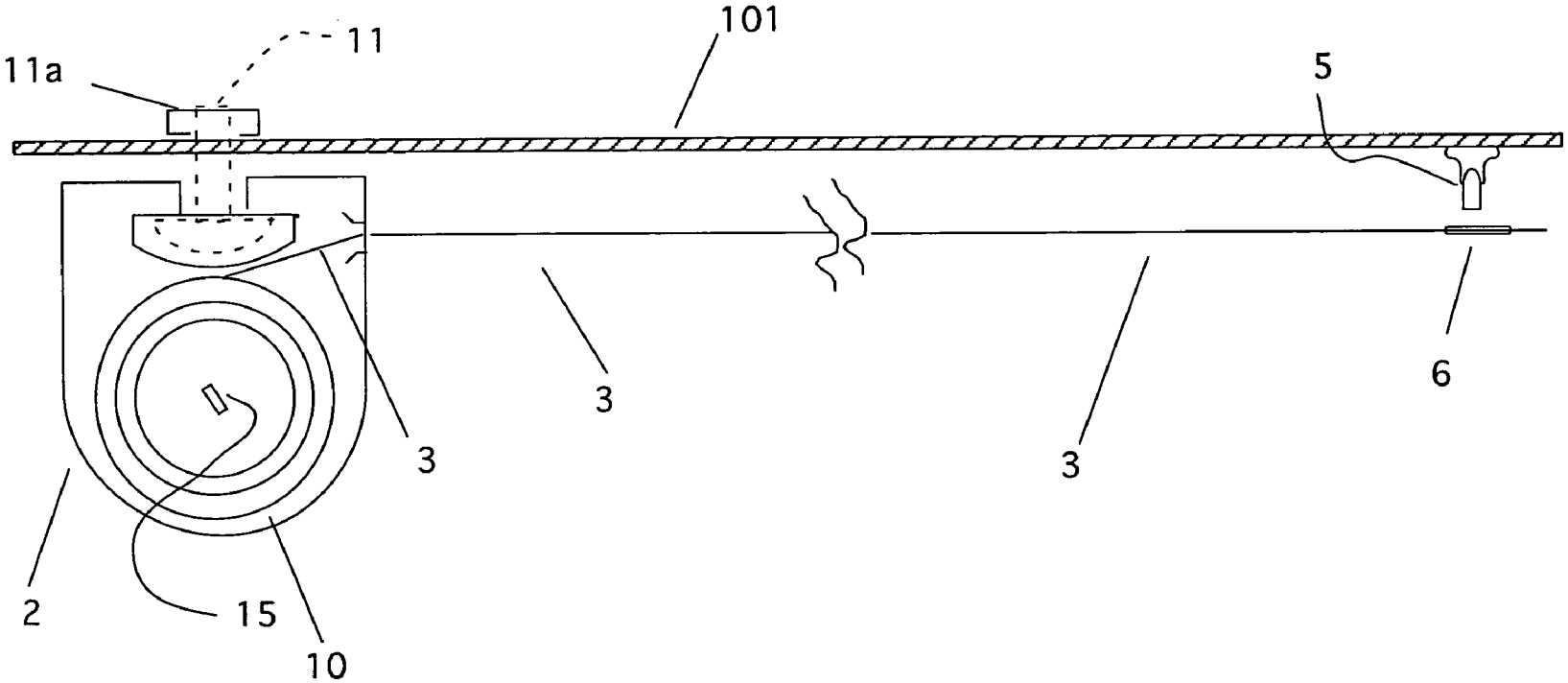
FIG. 5 is a top detail view of the device showing the mounting system, the winding system, and the means for securing the open end of the sign.

FIG. 5 is a top detail view of the device showing the mounting system, the winding system, and the means for securing the open end of the sign. Here, the cylinder 2 is shown secured to the bumper 101 as before. The bolt 11, securing nut 11*a* and slot 12 are shown. The sign 3 is shown extended. The winding mechanism 10 is shown as well as the top cap 9. Note that the top cap 9 has a slot 15 in it to allow a tool, such as a screwdriver, to manually wind the sign 3 if necessary. At the other end of the bumper is one of the fasteners 5. Note how the fastener aligns with the grommet 6. Again, there are many possible ways to secure the distal end of the sign to a bumper. For example, magnets can be placed on the sign. When the sign is extended, the magnets automatically stick to the bumper. However, this is not preferred because the sign may be used in many cases where a ferrous metal is not present. The preferred method uses some type of mechanical fastener, such as a common sense fastener. Thus, the fastener 5 shown in the figure may be a hook and the grommet on the sign is round. The grommet is then simple placed over the hook. On the other hand, the fastener may be a rotating disk. In this case, the grommet is a rectangular slot. The disk is aligned with the slot and then the sign is slid over the disk. Once the disk is fully protruding through the slot, the disk is rotated 90 degrees to lock the sign in place. Of course, any other fastener system that achieves the same results can be used.

Figure 6:
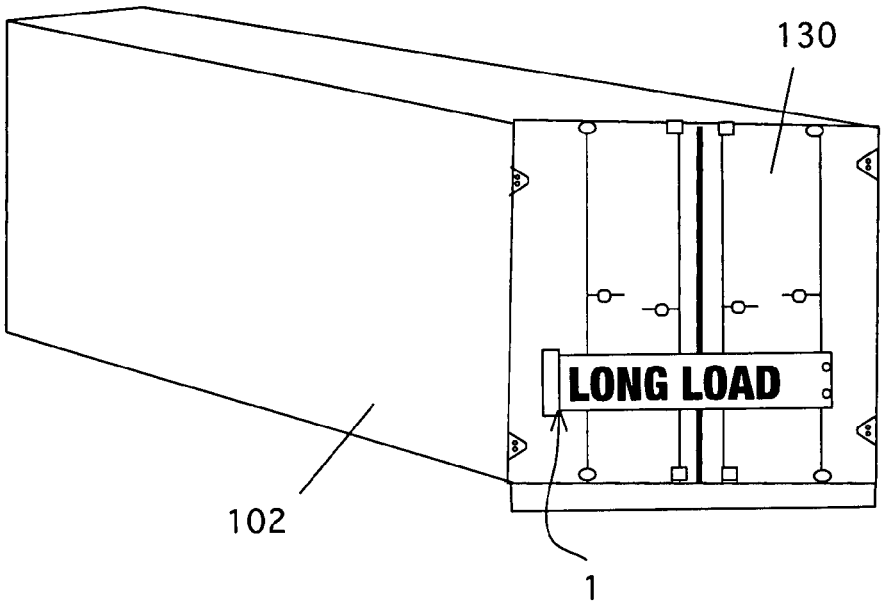
FIG. 6 is a rear view of a trailer box showing the invention in place.

The sign can be attached to many different types of vehicles. It is intended to be a permanent fixture. Some of the common uses for the invention are shown in the following figures:

FIG. 6 is a rear view of a trailer box showing the invention in place. Here, a common semi trailer or container 102 has the device 1 installed on the doors 103. When needed, the sign can be quickly extended and secured for use.

Figure 7:
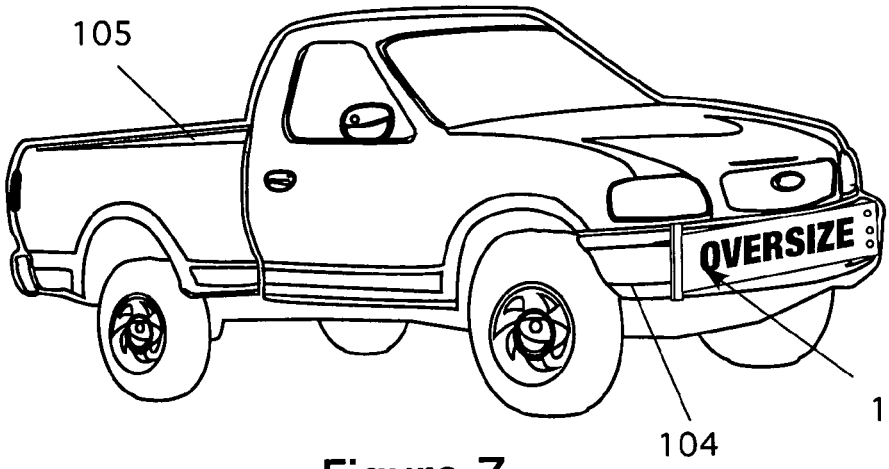
FIG. 7 is a perspective view of the device shown on a pick-up truck.

FIG. 7 is a perspective view of the device shown on a pick-up truck. Oftentimes, it is required that oversized loads have pilot cars both in front of the load and behind the load. Thus, the invention b1 can be installed on the bumpers 104 (front and back) of pick-up trucks 105 or other small vehicles for display when these vehicles are used in such hauling operations.

Figure 8:
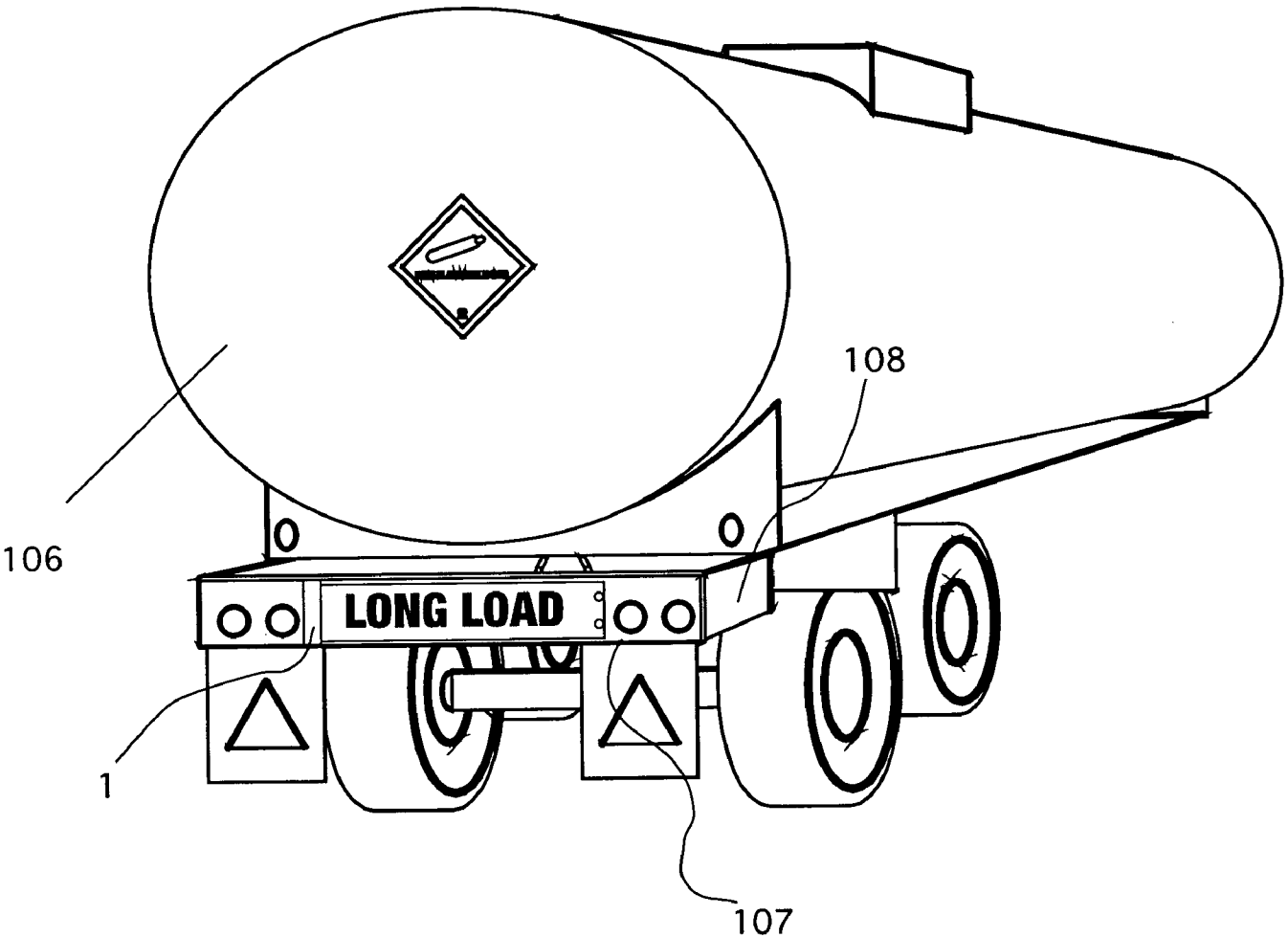
FIG. 8 is a rear perspective view of the device shown on a tanker.

FIG. 8 is a rear perspective view of the device shown on a tanker 106. Here, the sign is shown installed on the bumper 107 of the trailer 108. Similarly, the sign can be installed on the bumper of a flatbed trailer as well.

Figure 9:
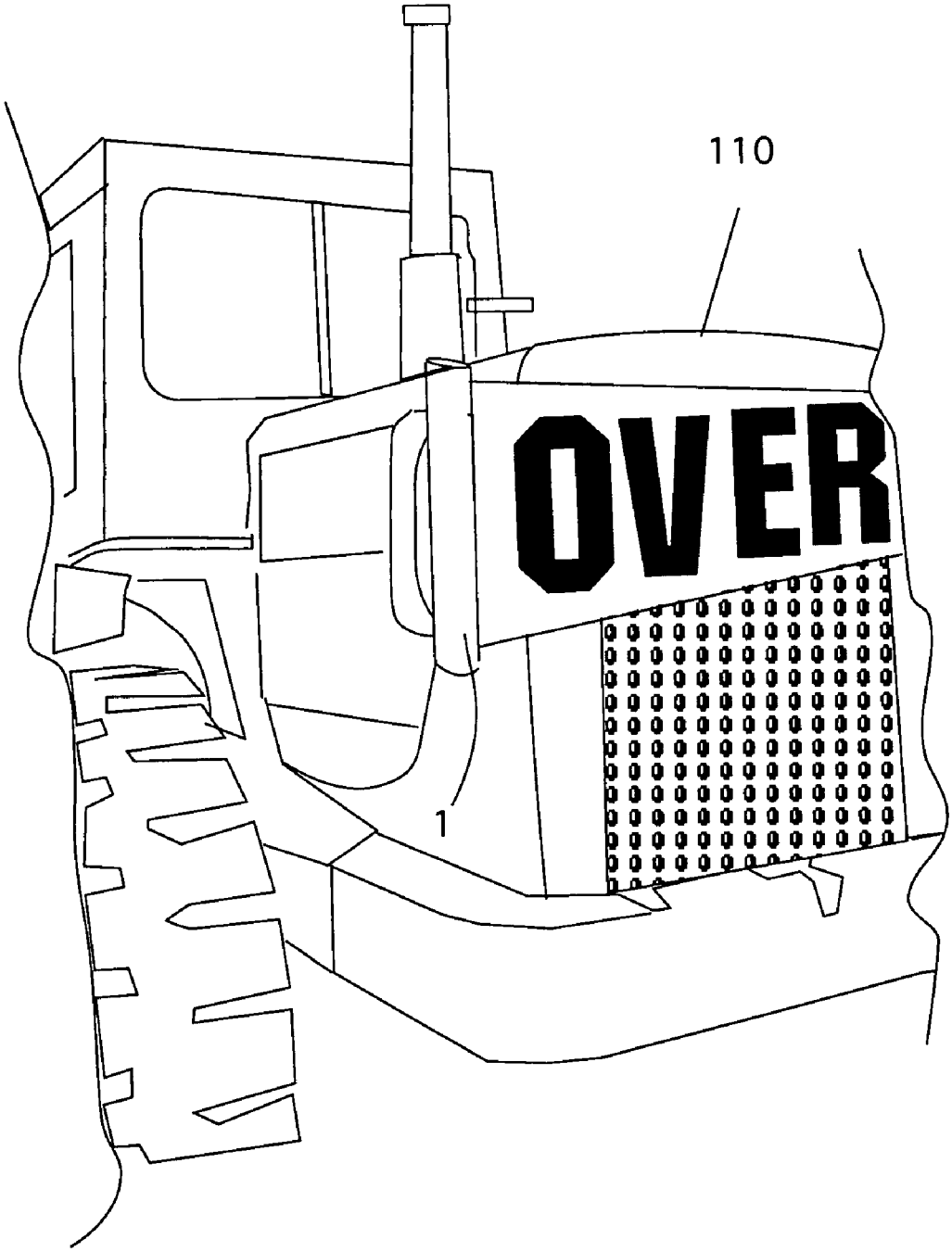
FIG. 9 is a partial view of the device secured to the rear of a piece of construction equipment.

FIG. 9 is a partial view of the device 1 secured to the rear of a piece of construction equipment 110. Occasionally, such equipment is considered too large for the normal highway use. Here, the device is installed as shown. This is an improvement over attaching a permanent sign because the permanent sign can be damaged due to prolonged exposure, can get in the way of controls or warning lights, etc. The device, on the other had can be used to quickly deploy the sign for transport and then retract it when the equipment is being used and the sign is no longer needed.

Figure 10:
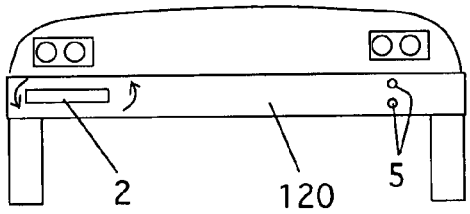
FIG. 10 is a front detail of a vehicle having a narrow bumper and the device stored in a horizontal position.
Figure 11:
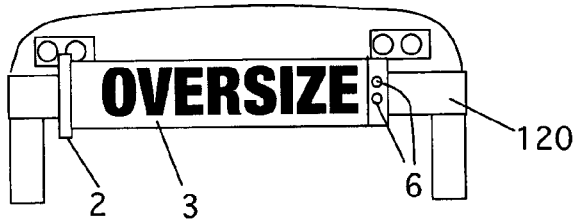
FIG. 11 is a front detail of a vehicle having a narrow bumper and the device stored in a vertical position with the sign deployed.

FIG. 10 is a front detail of a vehicle having a narrow bumper and the device stored in a horizontal position. In cases where a vehicle does not have sufficient bumper height to store the device in an upright position, an alternative embodiment allows the cylinder to be stored in a horizontal position until it is needed. Then, the cylinder can be rotated into the vertical position and the sign can be extended for use. In FIG. 10, the cylinder 2 is shown installed on a narrow bumper 120. As shown, the cylinder 2 is in a horizontal position for storage. Note the fasteners 5 on the opposite side of the bumper. FIG. 11 is a front detail of a vehicle having a narrow bumper and the device stored in a vertical position with the sign deployed. Here, the cylinder has been rotated into a vertical position and the sign 3 has been extended and secured to the fasteners 5 as discussed above.

Figure 12:
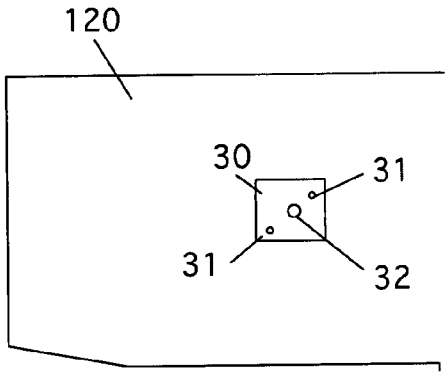
FIG. 12 is a detail of the bumper mounting plate used with one form of a rotating design.
Figure 13:
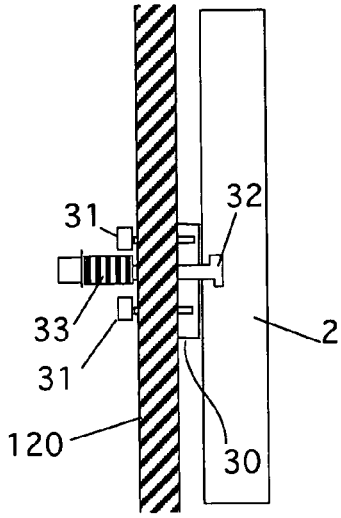
FIG. 13 is a side partial cutaway view of a bumper with the device installed and rotated in the vertical position.

To install the cylinder on the bumper so that it can be rotated, in one embodiment, a mounting plate 30 is used. FIG. 12 is a detail of the bumper mounting plate used with the rotating design. The plate 30 has two mounting screws 31 that secure it to the bumper. A spring-loaded bolt 32 is positioned in the center of the plate. FIG. 13 is a side partial cutaway view of a bumper with the device installed and rotated in the vertical position. In this view, the spring-loaded bolt 32 extends out of the plate. The cylinder 2 has a center slot into which, the head of bolt 32 fits. Once the cylinder is secured to the bolt, the spring 33 pulls the bolt and cylinder tight against the plate. For storage, the cylinder is horizontal, as noted before. To rotate it into a vertical position, the cylinder is pulled forward, compressing the spring 33, thereby extending the bolt head past the plate. Once clear, the cylinder is turned 90 degrees to a vertical position. Once it is in a vertical position, the cylinder is released. The spring then pulls the bolt and the cylinder tight against the plate again. Once secured, the sign can be extended and secured to the fasteners for use as described above. Of course, the above description is only one example as many other swivel type mounts, well known in the art, could be used as well.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A vehicle-mounted roll-up sign comprising:

a) a vehicle;

b) a housing;

c) a means for attaching said housing to said vehicle;

d) a winding mechanism roller installed in said housing;

e) a roll-up sheeting having a first end and a second end, wherein said first end is attached to said roller and said sheeting is wound about said roller;

f) a means for temporarily securing the second end of said roll-up sheeting to said vehicle, said means for temporarily securing being fixedly attached to said vehicle at a spaced-apart interval from said housing;

g) an attachment means at the second end of said roll-up sheeting for attaching said sheeting to said means for temporarily securing;

h) a means for retracting said roll-up sheeting into said housing, installed in said housing and being in operable communication with said winding mechanism roller;

i) wherein the means for attaching said housing to said vehicle includes a means rotating said housing from a horizontal position to a vertical position; and j) wherein the means rotating said housing further includes a means for locking said housing in said horizontal position and a means for locking said housing in said vertical position.

2. The vehicle-mounted roll-up sign of claim 1 wherein said roll-up sheeting is imprinted with at least one letter.

3. The vehicle-mounted roll-up sign of claim 1 wherein said roll-up sheeting is imprinted with a message.

4. The vehicle-mounted roll-up sign of claim 3 wherein said message imprinted on said roll-up sheeting is selected from the group of: "OVERSIZE", "LONG LOAD", "OVERSIZE LOAD" and "WIDE LOAD".

5. The vehicle-mounted roll-up sign of claim 1 wherein a material for said roll-up sheeting is selected from the group of: a retroreflective material, vinyl, and vinyl mesh.

6. The vehicle-mounted roll-up sign of claim 1 wherein the means for temporarily securing the second end of said roll-up sheeting to said vehicle comprises a single hook.

7. The vehicle-mounted roll-up sign of claim 1 wherein the means for temporarily securing the second end of said roll-up sheeting to said vehicle comprises a plurality of hooks.

8. The vehicle-mounted roll-up sign of claim 1 wherein the means for temporarily securing the second end of said roll-up sheeting to said vehicle comprises a common sense fastener.

9. The vehicle-mounted roll-up sign of claim 1 wherein the means for temporarily securing the second end of said roll-up sheeting to said vehicle comprises a plurality of common sense fasteners.

10. The vehicle-mounted roll-up sign of claim 1 wherein the means for temporarily securing the second end of said roll-up sheeting to said vehicle comprises a magnet.

11. The vehicle-mounted roll-up sign of claim 1 wherein the means for temporarily securing the second end of said roll-up sheeting said vehicle comprises a plurality of magnets.

12. The vehicle-mounted roll-up sign of claim 1 wherein the attachment means at the second end of said roll-up sheeting comprise a hole formed in said roll-up sheeting.

13. The vehicle-mounted roll-up sign of claim 1 wherein the attachment means at the second end of said roll-up sheeting comprise a plurality of holes formed in said roll-up sheeting.

14. The vehicle-mounted roll-up sign of claim 13 wherein the plurality of holes formed in said roll-up sheeting also include a plurality of grommets, installed in said plurality of holes.

15. The vehicle-mounted roll-up sign of claim 1 wherein the means for retracting said roll-up sheeting into said housing, installed in said housing and being in operable communication with said winding mechanism roller comprise a spring winding mechanism.

16. The vehicle-mounted roll-up sign of claim 15 wherein the means for retracting said roll-up sheeting into said housing further includes a manual winding mechanism.

17. The vehicle-mounted roll-up sign of claim 1 wherein said roll-up sheeting is attached to said vehicle when said housing is in said vertical position.

* * * * *